United States Patent [19]

Apuzzo, Jr. et al.

[11] 4,234,104

[45] Nov. 18, 1980

[54] TOOTHPASTE DISPENSER HAVING A SLIP CLUTCH DRIVE MECHANISM

[76] Inventors: Louis J. Apuzzo, Jr., 52 Fairfield St., New Haven, Conn. 06515; Frank Acquarulo, Jr., 87 Lenox St., East Haven, Conn. 06512

[21] Appl. No.: 911,816

[22] Filed: Jun. 2, 1978

[51] Int. Cl.[3] ..... B65D 35/28

[52] U.S. Cl. ..... 222/94; 141/362; 222/96; 222/101; 222/333

[58] Field of Search ..... 222/95, 96, 97, 101, 222/102, 105, 107, 333, 390, 511, 94; 401/123, 148, 164, 155, 191; 141/360, 361, 362; 64/30 R; 46/204

[56] References Cited

U.S. PATENT DOCUMENTS

| | | | |
|---|---|---|---|
| 2,570,755 | 10/1951 | Booth | 222/101 X |
| 2,731,187 | 1/1956 | Marquis | 141/361 |
| 2,845,964 | 8/1958 | Harland | 141/361 X |
| 3,151,616 | 10/1964 | Selfon | 222/102 X |
| 3,198,389 | 8/1965 | Dunning | 222/105 X |
| 3,228,210 | 1/1966 | Farmer | 64/30 R |
| 3,481,160 | 12/1969 | Georgi | 64/30 R |
| 3,501,054 | 3/1970 | Maurice | 222/102 |
| 3,605,684 | 9/1971 | McGinley | 64/30 R |
| 3,738,533 | 6/1973 | Bertrand | 222/102 |
| 3,860,147 | 1/1975 | Vessio et al. | 222/102 X |

*Primary Examiner*—Stanley H. Tollberg
*Assistant Examiner*—Fred A. Silverberg
*Attorney, Agent, or Firm*—Bachman and LaPointe

[57] ABSTRACT

The present invention discloses an improved apparatus for dispensing paste or the like from a collapsible tube. The apparatus comprises a case having an electric motor enclosed therein which, when actuated, moves a pair of rollers downwardly on both sides of the tube to thereby force paste therefrom. In the preferred embodiment of the present invention, the case is provided with a movable closure member at the bottom thereof which seals the exit nozzle of the toothpaste tube. A motor actuation switch is positioned with respect to the closure member so that the motor is automatically actuated when a toothbrush is positioned so as to move the closure member to uncover the outlet nozzle of the tube and at the same time cause the closure member to abut the switch.

2 Claims, 3 Drawing Figures

TOOTHPASTE DISPENSER HAVING A SLIP CLUTCH DRIVE MECHANISM

BACKGROUND OF THE INVENTION

The present invention relates to an improved apparatus for dispensing paste, cream or the like from a collapsible tube.

At the present time there are numerous products on the market which are housed in a collapsible container. Generally, the collapsible tubes which contain such products are squeezed by hand to discharge the contents thereof. A number of disadvantages have resulted from dispensing the contents of a collapsible tube by hand. It has been found that the tube becomes badly twisted which may cause a cracking of the tube wall thus resulting in loss of the product through the cracks when the tube is squeezed. In addition, it has generally been observed that a twisted tube cannot be squeezed sufficiently so as to completely expel the contents thereof thus resulting in the tube being discarded prior to complete evacuation. Finally, the general unsightly appearance of a twisted tube laying in full view in the bathroom is highly undesirable.

It is naturally highly desirable to develop an improved apparatus for dispensing paste from a tube so as to overcome the above-noted disadvantages. One such apparatus is disclosed in U.S. Pat. No. 2,837,243 in which a case is employed for holding a collapsible tube. A pair of rollers are actuated to move so as to collapse the tube and force paste therefrom. While this apparatus overcomes the disadvantages noted above it suffers from numerous disadvantages the most serious being the complexity of the gear mechanism, the large number of movable parts and the costly expense for making such a complex device.

A more simplified dispenser is disclosed in U.S. Pat. No. 3,860,147. While this dispenser has greatly reduced the complexity and number of movable parts over that of the previously noted U.S. patent, this apparatus still suffers from a number of inherent disadvantages. Firstly, in order to obtain greater amounts of paste, the brush must be constantly thrusted back and forth so as to actuate the gear which moves the rollers. In addition, the casing must be taken apart in order to reach a gear mechanism which must be manually operated to return the rollers to their initial position. Finally, there is no mechanism for indicating when the rollers have reached the end of the rods and thus expelled all the paste from the tube.

U.S. Pat. No. 3,738,533 discloses an electric motor operated toothpaste dispenser in which an electric motor drives a pair of rollers through a speed reducing gear train. Again, as is the case with the previously discussed U.S. patents, a number of disadvantages are inherent in the disclosed device. These problems are namely the cost of the gearing system, the failure to provide a closure cap for the tube which would allow for the paste to dry and the lack of an indicating means for making the operator aware of when the rollers are approaching their lowermost position and all the paste is expelled from the tube.

Accordingly, it is the principal object of the present invention to provide an improved dispensing apparatus which is both simple in construction and limited in the number of moving parts.

It is a particular object of the present invention to provide an electrically operated dispenser which is actuated by toothbrush positioning.

It is a further object of the present invention to provide an improved mechanism for indicating when the tube is fully collapsed.

It is still a further object of the present invention to provide improvements as aforesaid which are convenient and inexpensive to utilize and which result in high efficiency.

Further objects and advantages of the present invention will appear hereinbelow.

SUMMARY OF THE INVENTION

In accordance with the present invention, it has been found that the foregoing objects and advantages may be readily obtained.

The present invention relates to an improved apparatus for dispensing toothpaste or the like from a collapsible tube. In a preferred embodiment, a toothpaste tube is located within a housing such that a pair of rollers are positioned on either side of the tube. The rollers are adapted to reciprocate on a set of track means so as to compress the collapsible tube. Electric motor means is provided to drive the rollers and the motor means is actuated by inserting a toothbrush under the outlet nozzle of the tube. In the preferred embodiment, sensing means is provided to sense when the contents of the tube is about to run out; the sensing means is provided with an indicator so as to make the operator of the dispenser aware that the tube is nearly empty. In the preferred embodiment, the motor of the present invention is battery powered thus allowing for the dispenser to be easily portable.

The apparatus of the present invention is easy and economical to manufacture and offers a convenient and efficient mechanism for dispensing the contents of a collapsible tube.

By virtue of the employment of a limited number of movable parts and gears the incidence of malfunction and cost of repair is greatly reduced.

DETAILED DESCRIPTION

Figure 1:
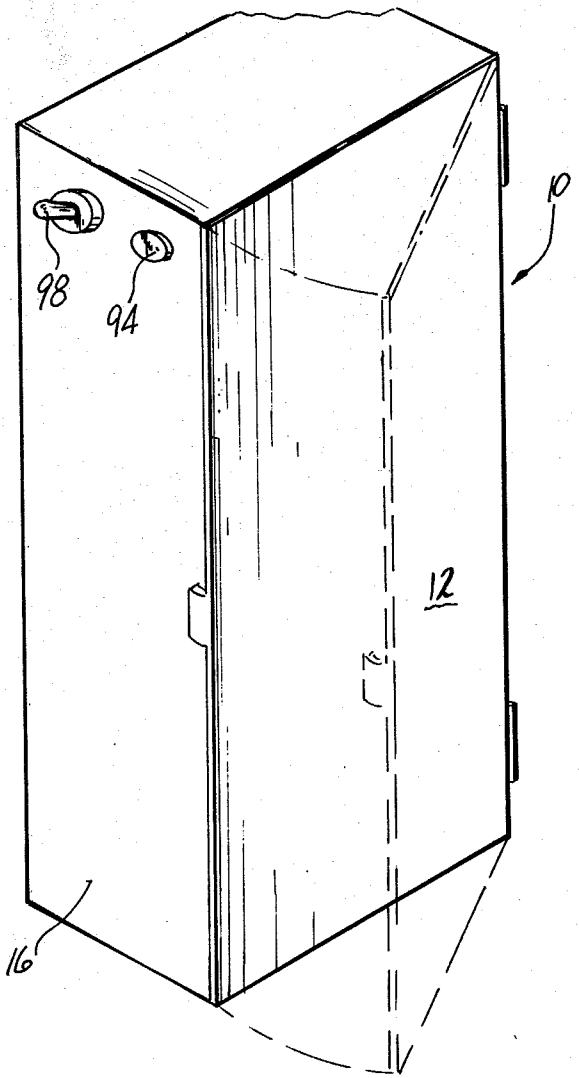
FIG. 1 is a perspective view showing the dispensing apparatus of the preferred embodiment of the present invention.
Figure 3:
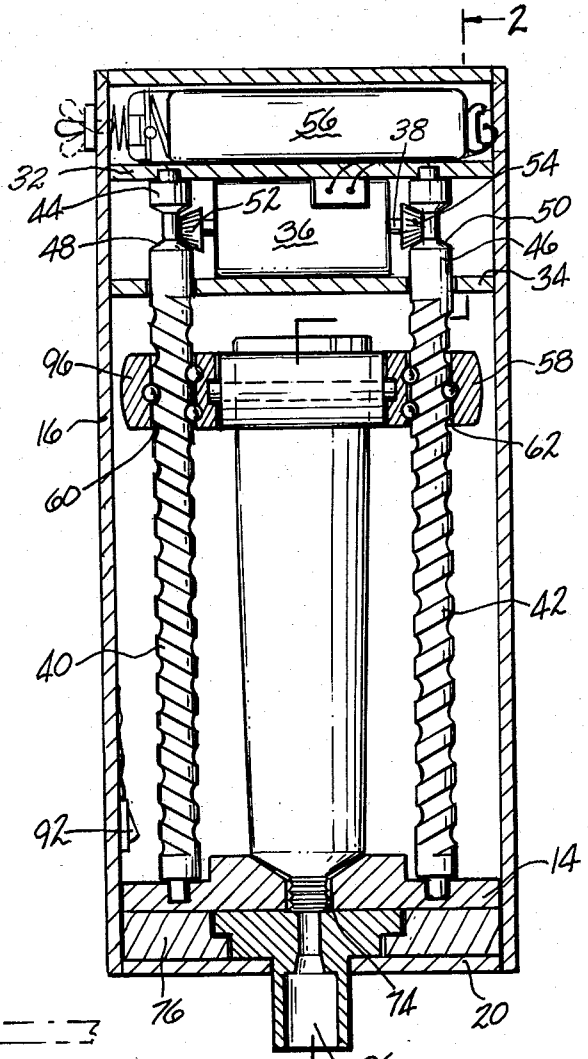
FIG. 3 is a fragmentary sectional front view taken along line 3—3 of FIG. 2.
Figure 2:
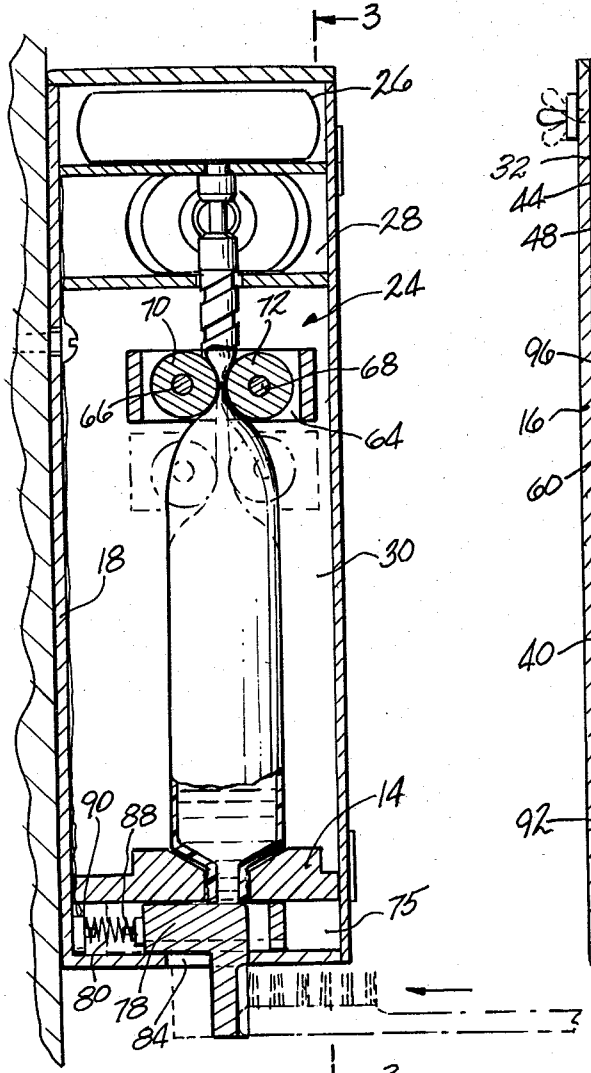
FIG. 2 is a fragmentary sectional side view taken along line 2—2 of FIG. 1.

Referring to FIGS. 1–3 the dispenser 10 is shown having a pivotal front door 12 with side walls 16, rear wall 18, and bottom wall 20 which forms an enclosure 24. The enclosure 24 is divided into three compartments 26, 28 and 30 by baffles 32 and 34.

As best seen in FIG. 3, a miniature reversible motor 36 is housed in compartment 28 and is provided with drive shaft 38. Positioned in compartment 30 are two vertically threaded shafts 40 and 42, respectively, which are bearingly mounted for rotational movement in baffle wall 14. Each shaft 40 and 42 is provided with an extension 44 and 46, respectively, which protrude through baffle 34 and are bearingly mounted in baffle member 32. Knurled grooves 48 and 50 are provided around the entire periphery of extensions 44 and 46 and are adapted to frictionally receive wheels 52 and 54 which are carried on drive shaft 38. The wheels may be made of rubber or any suitable material which would provide good frictional contact with the grooves. The frictional drive allows for an automatic slipping between the grooves and the wheels in the event that the shafts become jammed. It should be appreciated that rack and pinion gears may be substituted for the wheels and grooves and thereby accomplish the same result. Compartment means 26 houses a battery pack 56 which is adapted to drive motor 36. The battery pack 56 is adapted to be recharged with an AC adapter which may be plugged into a standard 120 VAC outlet. The motor can be operated via the same adapter.

Positioned in compartment 30 is a carriage 58 provided with holes 60 and 62 adapted to mate with thread shafts 40 and 42 so as to cause carriage 58 to move up and down on shafts 40 and 42 as they are rotated in a clockwise and counterclockwise manner by reversible motor 36. The carriage 58 is provided with an opening 64 adapted to receive shafts 66 and 68 on which rollers 70 and 72 are rotatably mounted. While the shafts are illustrated as being fixed, it should be appreciated that either one or both of the shafts may be resiliently mounted on the carriage so that the space between the roller may increase to accommodate various sized tables.

With reference to FIG. 3, baffle wall 14 is provided with a discharge passage 74. The closure member 78 is slidably mounted in guide 76 located in chamber 75 formed by baffle wall 14 and bottom wall 20 so as to move between a first position where said discharge passage 74 is uncovered. Spring 80 biases closure member 78 to cover discharge passage 74. Closure member 78 is provided with a through bore communicating the outlet of the toothpaste tube with the toothbrush so as to prohibit the collection of toothpaste in chamber 75. Closure member 78 is provided with an abutment 82 which projects through a slot 84 in bottom wall 20, the abutment has a slight recess 86 for receiving a toothbrush. A projection 88 is provided on the rear of closure member 78 for depressing on-off push button switch 90 located on rear wall 18 so as to actuate motor 36 when the closure member 78 is moved to uncover discharge passage 74. Spring 80 normally biases closure member 78 to cover passage 74.

Referring to FIG. 3, a switch 92, shown in its off position, is located on side wall 16 and operates indicator light 94 on the side wall 16 of dispenser 10 when closed. Carriage 58 has an oval cam surface 96 which depresses switch 92 to its on position as the carriage 58 travels down shafts 40 and 42. A toggle switch 98 is provided on the side wall of dispenser 10 for reversing the polarity of motor 36 so as to move carriage 58 upwards on shafts 40 and 42 when switch 90 is depressed.

The operation of the dispenser of the present invention will be better understood with reference to FIGS. 2 and 3 as illustrated herein.

With carriage 58 in its uppermost position, a collapsible tube, such as a tube of toothpaste is inserted into compartment 30 such that the nozzle of the tube is held within baffle wall 14 and supported by a dish shaped indentation provided therein with the uppermost end of the tube being inserted between rollers 70 and 72. In order to discharge the desired quantity of paste from the tube, the operator inserts his toothbrush in recess 86 of abutment member 82 and pushes back thereon against spring 80 so that projection 88 contacts button 90 to actuate motor 36 to drive shafts 40 and 42 so that the carriage member 48 is moved downward such that rollers 70 and 72 compress the tube to thereby discharge paste therefrom. When the desired amount of toothpaste is on the brush, the operator withdraws his toothbrush which causes spring 80 to bias closure member 78 so that it covers discharge passage 74 while removing any excess toothpaste which may have been left hanging from the passage. The operator can then remove any excess paste from abutment 82. The aforenoted operation is continuously carried out until the carriage member 58 has traversed almost the entire length of the shafts 40 and 42 at which time almost all the paste has been discharged from the tube. When the carriage 58 approaches its most downward position, cam surface 96 on the carriage depresses switch 92 which turns on indicator light 94 indicating to the operator that the carriage is approaching its lowermost position and that the tube is almost completely empty. At this point, the operator moves toggle switch 98 to the position to reverse the polarity of the motor 36. The operator then pushes abutment member 82 so as to again depress switch 90 which actuates the motor 36 which moves the carriage 58 to its uppermost position at which point the operator may extract the exhausted tube from the container and replace it.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. An apparatus for dispensing toothpaste from a collapsible toothpaste tube onto a toothbrush which comprises:

a housing;

battery powered motor means located within said housing;

means for powering said motor means located within said housing;

output shaft means directly associated with said motor means;

threaded shaft means positioned within said housing;

coupling means directly associated with and integral with said motor output shaft means and said threaded shaft means so as to rotate said threaded shaft means upon rotation of said output shaft means, said coupling means comprising a wheel means on said output shaft means which frictionally engages groove means on said threaded shaft means so as to drive said threaded shaft means and allow for slipping between said wheel means and said groove means in the event of excessive load on said threaded shaft means;

roller means associated with said shaft means so as to move on said shaft means as said shaft means rotates;

outlet means associated with said housing through which said toothpaste from said collapsible tube is expelled;

closure member provided with a through bore positioned beneath said outlet means and reciprocally movable across said outlet means between a first position where said outlet is closed to a second position where said through bore communicates with said outlet means so that said outlet is opened, said closure member further including an extension which lies in a plane substantially perpendicular to the axis of movement of said closure member, said extension being provided with a recess;

first switch means associated with said motor means for actuating said motor means by said power means so as to rotate said shaft means;

a toothbrush received in said recess for moving said closure member from said first position to said second position wherein said closure member directly engages said first switch means so as to actuate said motor means such that said roller means moves on said shaft means and said toothpaste is applied to said toothbrush;

second switch means associated with said motor means for reversing the polarity of said motor means so as to selectively rotate said shaft means in a clockwise and counterclockwise manner upon actuation of said motor means such that said roller means moves in a first direction and a second direction on said shaft means;

third switch means associated with said power means and actuated by said roller means for actuating light indicating means when said roller means has moved in said first direction so as to completely dispense the contents of said collapsible tube; and further including a baffle wall positioned above said closure member and defining with said housing a chamber in which said closure member reciprocates, said through bore prevents accumulation of toothpaste in said chamber, said baffle wall being provided with a dish-shaped indentation for supporting said toothpaste tube.

2. An apparatus according to claim 1 wherein said housing includes a single pivotably mounted door on the front thereof which allows for easy access to said power means, said motor means, and said collapsible tube.

* * * * *